United States Patent [19]

Shekel et al.

[11] 4,345,807

[45] Aug. 24, 1982

[54] BATTERY CABLE CONNECTOR

[75] Inventors: Joseph Shekel, New York; Joseph DeStefano, Carle Place, both of N.Y.

[73] Assignee: Auto-Line Manufacturing Corp., Copaigue, N.Y.

[21] Appl. No.: 153,156

[22] Filed: May 27, 1980

Related U.S. Application Data

[63] Continuation-in-part of Ser. No. 125,218, Feb. 27, 1980, abandoned.

[51] Int. Cl.[3] ..... H01R 11/24; H01R 27/00

[52] U.S. Cl. ..... 339/31 B; 339/29 B; 339/228; 339/95 B

[58] Field of Search ..... 320/25; 339/228, 229, 339/260, 261, 108 R, 108 TP, 29 B, 95 B, 10, 152, 263 B, 224, 220 R, 31 R

[56] References Cited

U.S. PATENT DOCUMENTS

| | | | |
|---|---|---|---|
| 1,912,653 | 6/1933 | Olson | 339/220 R |
| 2,073,466 | 3/1937 | Del Camp | 339/220 R X |
| 3,745,516 | 7/1973 | Lieberman | 339/228 |
| 4,006,952 | 2/1977 | Puckett | 339/29 B X |
| 4,082,401 | 4/1978 | Kruszecki | 339/224 X |

*Primary Examiner*—Eugene F. Desmond

*Attorney, Agent, or Firm*—Auslander, Thomas & Morrison

[57] ABSTRACT

A battery cable connector for top and side battery terminals has two resiliently movable gripping members whose end portions are manually separable from a normally closed state to an open state and jaws formed on the end portions for engaging a top battery terminal when in the closed state. A side battery terminal clamp is connected to a support member which is pivotally mounted on the end portion of one gripping member for pivotal movement of the clamp, in a plane radial to the direction of movement of the end portions, between a retracted position wherein the jaws are free to engage a top battery terminal and an extended position wherein the clamp projects from the end portions and is free to engage a side battery terminal. When the jaws comprise meshing circumferentially positioned teeth, optional positions may be selected for the battery terminal clamp.

14 Claims, 15 Drawing Figures

FIG. 1
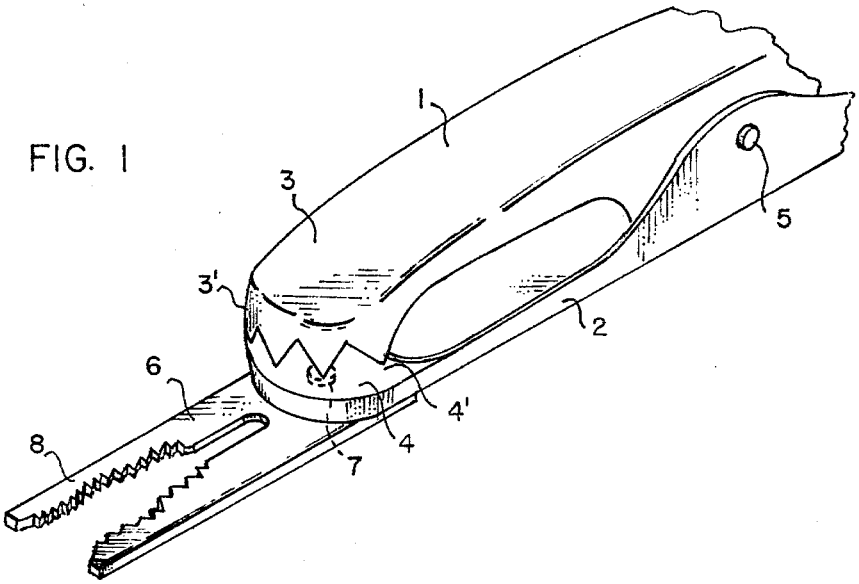
FIG. 3
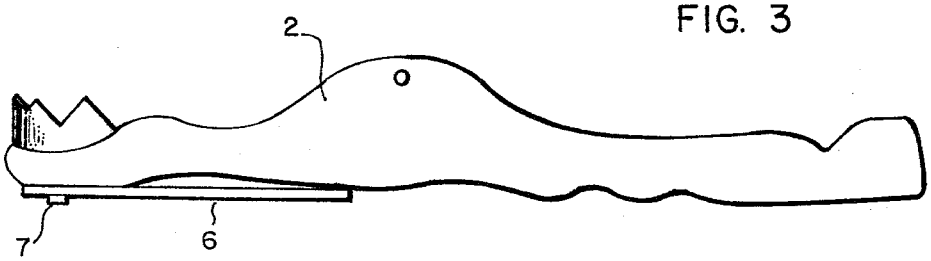
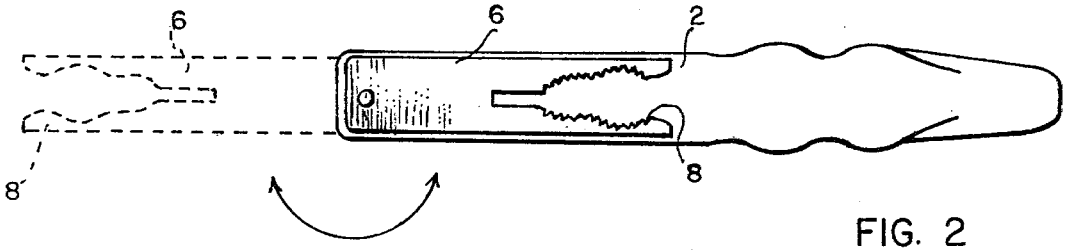
FIG. 2
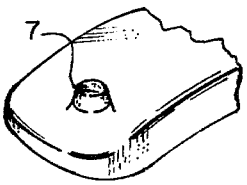
FIG. 12

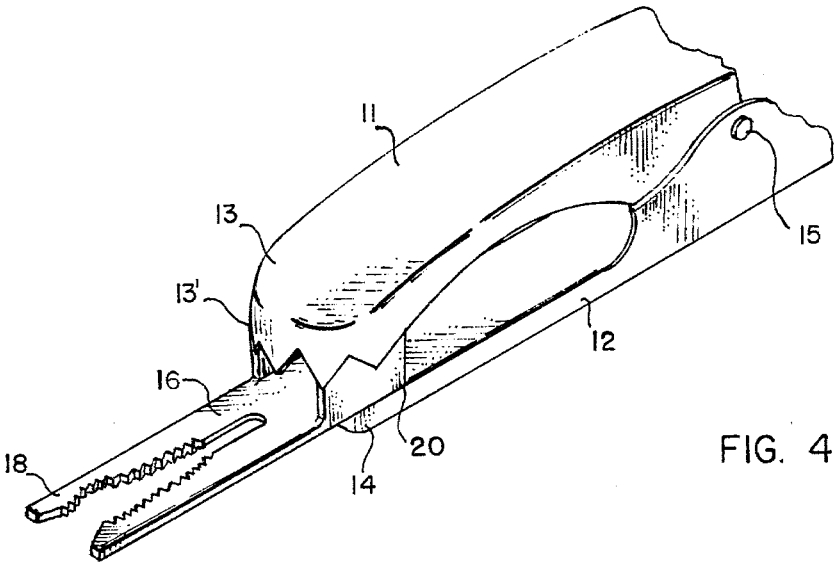
FIG. 4
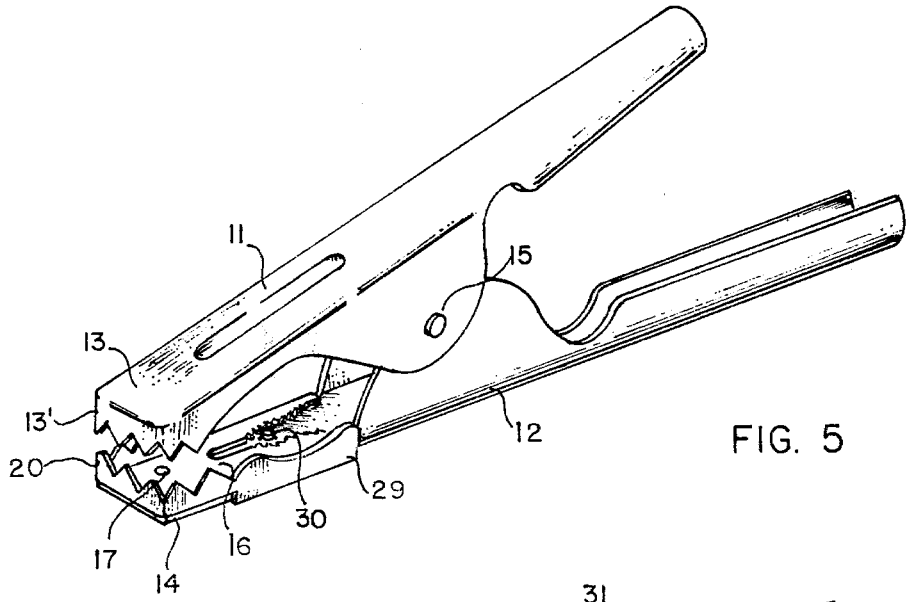
FIG. 5
FIG. 15
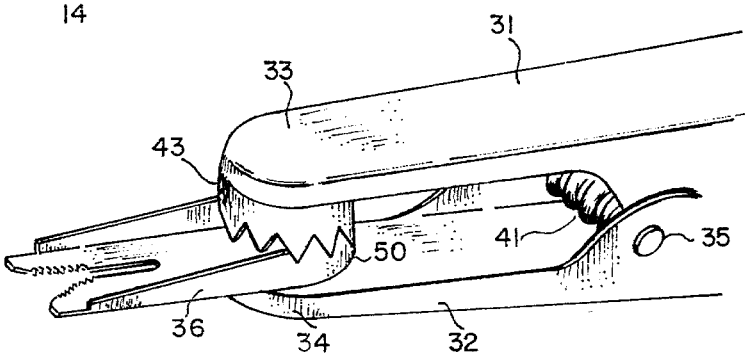

FIG. 6
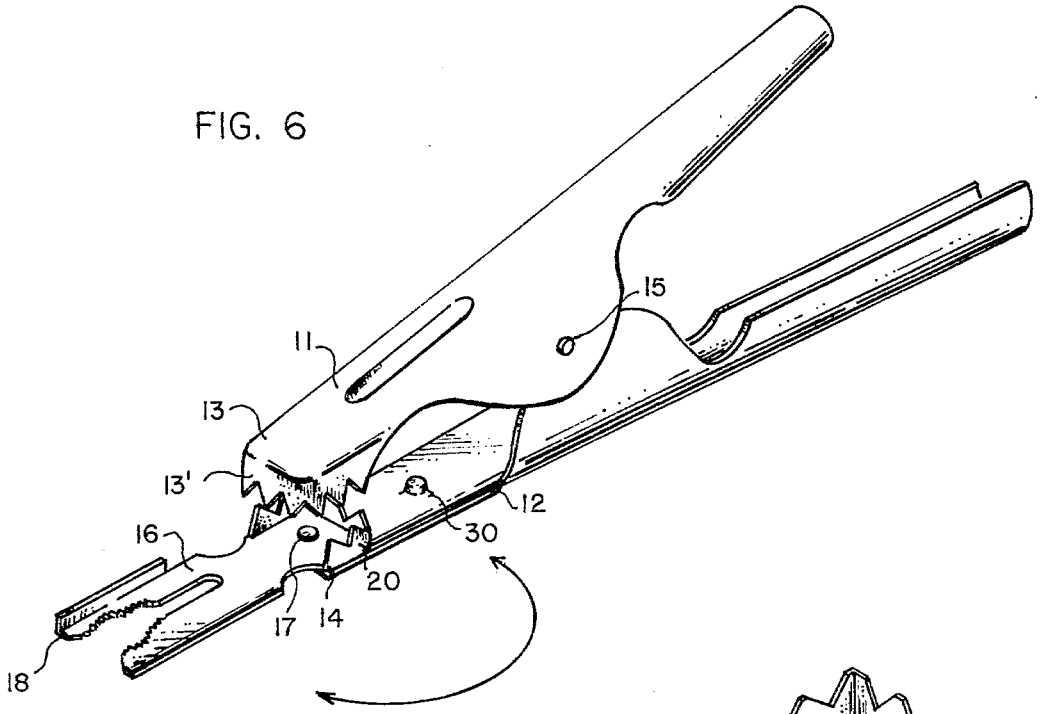
FIG. 7
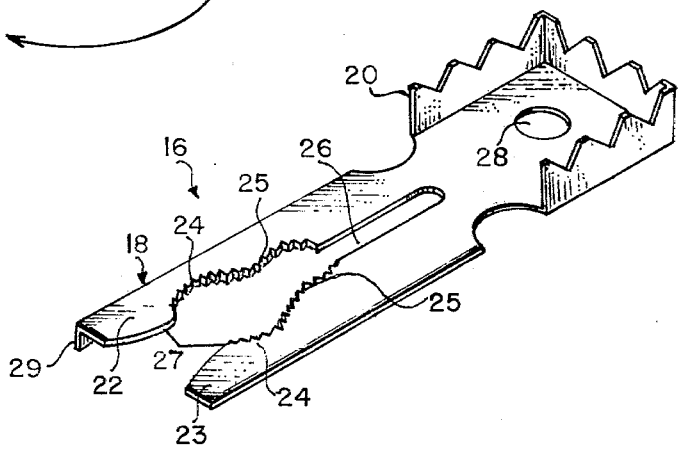
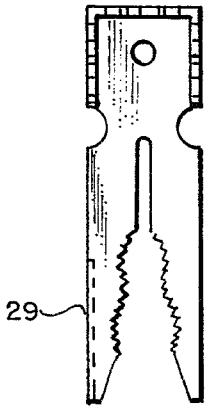
FIG. 9
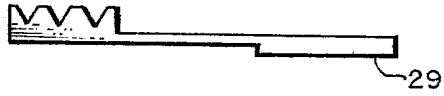
FIG. 8

BATTERY CABLE CONNECTOR

BACKGROUND OF THE INVENTION

The present invention relates to battery cable connectors and in particular, battery cable connectors for top and side battery terminals and is a continuation in part of Ser. No. 125,218 filed Feb. 27, 1980 in Group 322 now abandoned.

In the past, conventional motor vehicle batteries included terminal posts which project upwardly from the top of the battery. When it was desired to apply a booster or charging cable to these batteries, a cable connector having jaws formed on two resiliently pivoted gripping members was used, as shown in U.S. Pat. Nos. 4,145,648 and 4,163,134.

Recent developments have produced a side terminal battery in which battery cable terminal bolts are screwed into threaded positive and negative terminal receptacles in the side wall of the battery. The receptacles, at most, project only slightly from the side wall. This makes it difficult to readily engage the side battery terminal with the traditional gripping jaws mentioned above. As a result, an auxiliary clamp for side battery terminals has been developed, as disclosed in U.S. Pat. No. 3,745,516, which engages with the side battery terminal and is thereafter gripped by the traditional gripping jaws. This device has the disadvantage of not providing a sure connection between the clamp and crimping jaws, and further, the probability of misplacing a small clamp in storage is high, given the conditions under which battery cables are kept when not in use.

SUMMARY OF THE INVENTION

The main object of the present invention is to provide a battery cable connector which eliminates the disadvantages of the prior art device.

Another object of the invention is to provide a battery cable connector wherein the gripping jaws and side terminal clamp are connected together as a single unit with the clamp movable from a retracted position, when not in use, to an extended position, when used to connect to a side battery terminal.

A further object of the present invention is to provide a battery cable connector wherein the clamp is maintainable in the extended position by the gripping jaws formed in part by the pivotable support to which the clamp is connected.

A further object of the present invention is to have the clamp maintainable in a plurality of selected positions to meet varying conditions.

These and other objects of the present invention are achieved by the battery cable connector according to the present invention which comprises two resiliently movable gripping members having end portions which are normally separable from a normally closed state to an open state, means disposed on the end portions of the gripping members to form jaws for engaging a top battery terminal when the gripping members are in the closed state and means including a side battery terminal clamp mounted on one gripping member for pivotal movement of the clamp in a plane radial to the direction of movement of the end portions between a retracted position wherein the jaws are free to engage a top battery terminal and an extended position wherein the clamp projects from the end portions and is free to engage a side battery terminal.

In one preferred embodiment, the jaws are formed by teeth on the inner faces of the end portions of the gripping members and the pivotally mounted means includes a planar support member pivotally connected to the outer face of the end portion of one gripping member.

In a particularly advantageous embodiment, the pivotally mounted means comprises a support member pivotally connected to the inner face of the end portion of one gripping member and having the clamp at one end and teeth at the other end at which the pivot axis is located. When the clamp is retracted, the teeth on the support member coact with the teeth on the other gripping member to form the jaws. When the clamp is extended, the teeth on the support member and the teeth on the other gripping member coact to maintain the clamp in that position when the gripping members are in the normally closed state. In this way, the support member teeth serve a dual function of the lower jaw of the top battery terminal gripper jaw to insure proper grip and good electrical contact and as a non-slip locking device when the clamp is pivoted to its extended position for use with a side battery terminal.

A configuration of teeth in the jaw, arranged so that both sets of teeth are along a circumference of a circle and interengagable, permits the clamp to be firmly held in a plurality of selected positions and is in aid in setting the clamp in awkwardly limited spaces. An embodiment including this configuration is preferred for its utility of adaptability.

The connector of this embodiment also may comprise means for maintaining the clamp in the retracted position which advantageously includes an aperture in the support member and a detent projecting on the inner face of the end portion of the one gripping member which is engageable with the aperture when the clamp is retracted. This aperture is advantageously part of the space between the arms of the clamp as will be explained hereinafter.

The support member in these embodiments is pivotally connected by a rivet through holes in the support member and gripping member, or may advantageously be formed by material drawn from the gripping member to form a pivot post received in a pivot aperture of the support member and peened to produce a rivet-like member which enables the support member to be pivoted with no movement other than that in the plane radial to the movement of the end portions of the gripping members.

The side battery terminal clamp is preferably planar metal with two spaced apart, resiliently spreadable arms. The space between the arms preferably includes a slotted snap-in section when pushed onto the slotted or grooved diameter of the side post terminal to ensure proper mechanical and electrical contact and a nut snap-on section when pushed onto the parallel sides of a side post terminal nut so that the requisite contact is made. The sureness of the contact for both sections is advantageously improved by providing sawtooth or serrated edges along the inner edges of these sections.

In a particularly commercial embodiment, the clamp includes a depending flange at one side thereof which abuts the side of the end portion and acts as a finger tip safety grip which permits safe pivoting of the clamp without the pinching of the fingers.

Although such novel feature or features believed to be characteristic of the invention are pointed out in the claims, the invention and the manner in which it may be carried out, may be further understood by reference to the description following and the accompanying drawings.

BRIEF DESCRIPTION OF THE DRAWINGS

FIG. 1 is a partial perspective view of one embodiment of the battery cable connector according to the invention.

FIG. 2 is a bottom view of the connector of FIG. 1;

FIG. 3 is a side view of one connector arm as shown in FIG. 2;

FIG. 4 is a partial perspective view of a second embodiment of a battery cable connector according to the invention;

FIG. 5 is a perspective view of the connector of FIG. 4 in a different state;

FIG. 6 is a perspective view of the connector of FIG. 4 in another state;

FIG. 7 is a perspective view of the clamp and support according to the embodiment of FIG. 4;

FIG. 8 is a side view of that shown in FIG. 7;

FIG. 9 is a top view of that shown in FIG. 7;

FIG. 12 is a detail of a drawn rivet pivot pin of the invention;

FIG. 15 is a partial side elevation of the cable connector of FIG. 13 with the teeth of the jaw interengaged.

Referring now to the figures in greater detail, where like reference numbers denote like parts in the various figures.

DETAILED DESCRIPTION OF THE INVENTION

Figure 10:
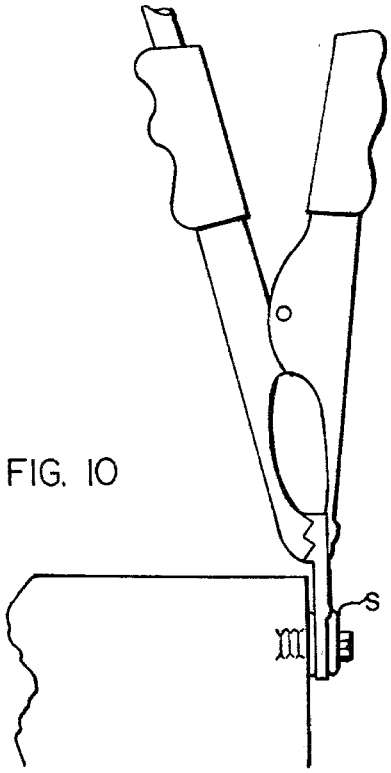
FIG. 10 shows the connector of FIG. 4 in use with a side battery terminal.

Referring now to FIGS. 1–3, a first embodiment of the battery cable connector for booster cable, clamping cables and the like, according to the present invention is described hereinafter. The same reference numerals are used throughout the drawings to indicate the same elements.

As shown therein, two gripping members 1, 2 are hingedly connected at pin 5 and biased by a spring (not shown) into the closed state which is shown. One of the gripping members 1, 2 is suitably connected to an electrical conductor such as cable (not shown) and it is usually desirable to insulate the gripper members rearwardly of the pivot pin 5 to prevent shocks.

The end portions 3, 4 of gripping members 1, 2 are separable when a manual force is applied past the pin 5 and are configured to have teeth 3', 4' on the inner faces thereof to form jaws for gripping a top battery terminal. In this embodiment a support member 6 is pivotally mounted at pivot pin 7 to the outer face of end portion 4. The support member 6 includes a side battery terminal clamp 8 thereon, which is pivotable between the retracted position shown in FIG. 2 and the extended position shown in FIGS. 1 and 3. In the retracted position, the jaws are free to engage a top battery terminal and in the extended position the clamp 8 projects from the end portions 3, 4 and is free to engage a side battery terminal. The details of the clamp 8 will be explained hereinafter with respect to FIGS. 7–9.

The support member 6 is pivotally connected to end portion 4 by pivot pin 7 which extends through a corresponding aperture therein. The pin 7 may be a rivet, passing through an aperture in end portion 4, or it may be drawn from the material of the gripping member 2 itself, such as aluminum, copper, steel, etc., and peened at the end to form a stop head.

Referring now to FIGS. 4–10, a second embodiment of the connector according to the invention is described and wherein like numerals signify like elements throughout.

In this embodiment, the gripping members 11, 12 are hingedly connected at 15 and biased into the closed state by a spring (not shown). One of the gripping members 11, 12 is connectable to an electrical cable (not shown) and the gripping members 11, 12 have end portions 13, 14 which are separable in response to a manual force applied at the other side of the hinge pin 15. When separated, the end portions 13, 14 are in the open state, as shown in FIGS. 5 and 6.

Pivotally connected onto the inner face of end portion 14 is support member 16. The pivotal connection is at pivot pin 17, which can comprise the drawn pivot pin or rivet, as described with respect to the first embodiments which extends through pivot aperture 28, which is shown in FIG. 7.

The support member 16 is pivotally mounted on one end and has the side battery terminal clamp 18 connected at the other end and, when the end portions 11, 12 are in the open state as shown in FIGS. 5 and 6, can pivot in a plane radial to that of the movement of end portions 13, 14 with respect to hinge pin 15, from the retracted position shown in FIG. 5 and the extended position shown in FIGS. 4 and 6.

Figure 11:
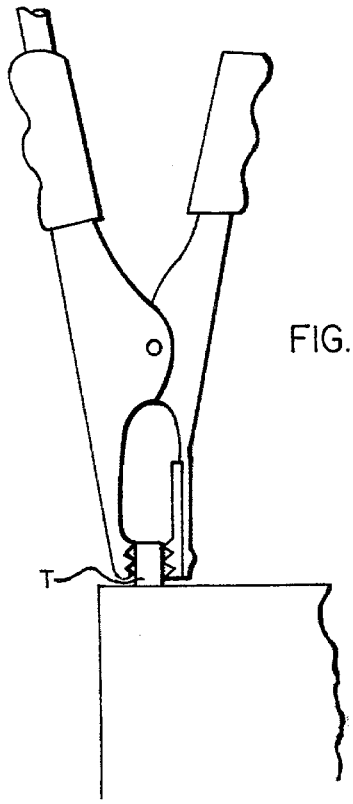
FIG. 11 shows the connector of FIG. 4 in use with a top battery terminal.

The support member 16 also has teeth 20 thereon that pivot with the clamp and are configured to coact with teeth 13', when the clamp 18 is retracted, to form the gripping jaws for a top battery terminal, as shown in FIGS. 5 and 11. The teeth 20 are also configured to engage with teeth 13', when the clamp 18 is in the extended position, as shown in FIGS. 4 and 10, to maintain the clamp 18 in the extended position by not permitting any pivotal movement thereof.

The pivotally mounted support member 16 is shown in more detail in FIGS. 7–9. As shown therein, it is basically planar, though, with the exception of the teeth 20 and the finger protecting flange 29, which will be described later. The clamp portion 18 comprises two spaced apart, resiliently spreadable arms 22, 23. The inner surfaces of the arms 22, 23 are configured to serve different functions. Surfaces 27 serve to receive the desired portion of the side terminal and taper inwardly to cause the resilient spreading of the arm. Surfaces 24 form a slotted snap-on section when pushed onto the slotted or grooved diameter of a battery side post terminal. The sawtooth or serrated edges thereof provide for a good mechanical and electrical contact. Surfaces 25 define a nut snap-on section when pushed onto the parallel sides of the side post terminal nut so that it will hold securely. Again the sawtooth or serrated edges thereof insure a good electrical and mechanical connection. The last section is slot 26 which enables the resilient spreading and which dually serves the purpose of acting as part of means for maintaining the clamp 18 in the retracted position. Slot 26 acts as an aperture which coacts with detent projection 30, shown in FIGS. 5 and 6, to prevent any undesired pivoting of teeth 20 when the clamp 18 is in the retracted position as shown in FIG. 5.

Figure 13:
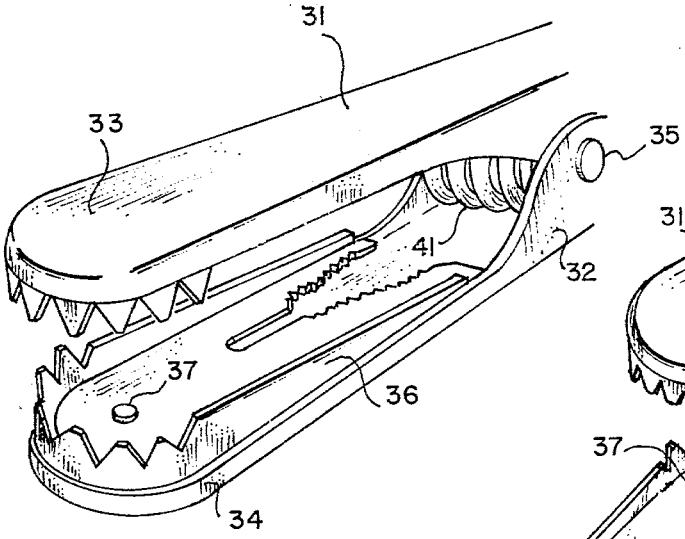
FIG. 13 is a partial perspective view of a variant embodiment of the battery cable connector of FIG. 4.
Figure 14:
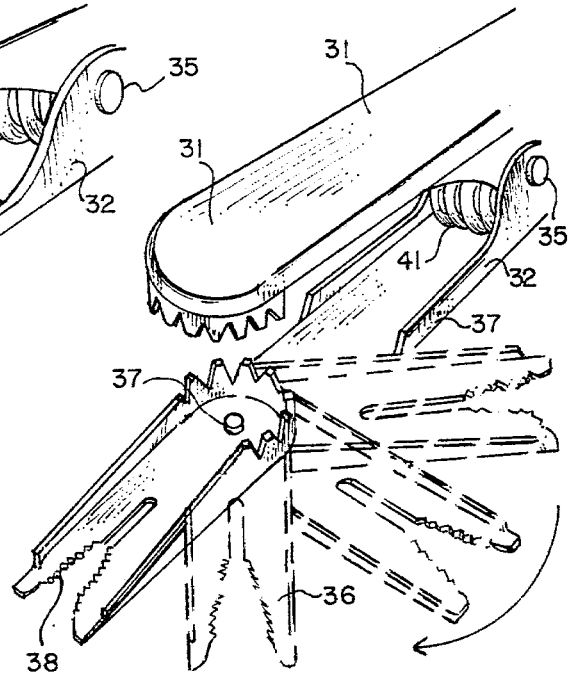
FIG. 14 is a partial perspective view of the clamp and support of FIG. 13 in selected positions.

Referring now to FIGS. 13–15, another embodiment of the connector according to the invention is described and wherein like numerals signify like elements throughout.

In this embodiment, the gripping members 31, 32 are hingedly connected at 35 and biased into the closed state by a spring 41. One of the gripping members 31, 32 is connectable to an electrical cable (not shown) and the gripping members 31, 32 have end portions 33, 34, which are separable in response to a manual force applied at the other end of the hinge pin 35. When separated, the end portions 33, 34 are in open state, as shown in FIGS. 13 and 14.

Pivotally connected onto the inner face of the end portion 34, is support member 36. The pivotal connection is at pivot pin 37, which can comprise the drawn pivot pin or rivet, as described with respect to the first embodiment, which extends through the pivot aperture such as pivot aperture 28, as shown in FIG. 7.

The support member 36 is pivotally mounted on one end and has the side battery terminal 38 connected at the other end, and when the end portions 31, 32 are in open state, as shown in FIGS. 13 and 14, can pivot in a plane, radial to that of the movement of the end portions 33, 34, with respect to hinge pin 35, from the retracted position shown in FIG. 13 and the extended position shown in FIGS. 14 and 15.

The support member 36 also has teeth 50 thereon, that pivot with the clamp and are configured to coact with the teeth 43, when the clamp 38 is retracted, to form the gripping jaws for a top battery terminal, as shown in FIGS. 13 and 11. The teeth 50 are also configured to engage with the teeth 43, when the clamp 38 is in its extended position, as shown in FIGS. 15 and 10, to maintain the clamp 38 in extended position by not permitting any pivotal movement thereof.

The pivotally mounted support member 36 as shown, is substantially the same as the prior embodiment as shown in detail in FIGS. 7 through 9; it is basically planar, though, with the exception of the teeth 50 and the finger protecting flange 29.

The major difference over the other embodiments is that the teeth 43, 50 are mounted along the circumference of a circle and are interengagable to coact in selected positions along their circumference as shown in FIG. 14. Thus, where the battery, a shown in FIG. 10, is located in the space too constricted for the connector of the present invention to be in a vertical position, as shown, the teeth 43, 50 may be interengaged in any selected position as indicated in FIG. 14, and the terminal clamp 38 then engaged.

In one particular commercial embodiment, clamp 18 is preferably composed of cold drawn steel, although other suitable metal conductors can be used. The clamp 18 is approximately $\frac{1}{8}$ inch thick, about 1 inch wide and $1\frac{3}{4}$ inch long. The surfaces 24 define a circle of about 50 inches in diameter; however, this can be variable and is based upon manufacturers' specifications for the side battery terminals.

In a further advantageous embodiment, a finger protecting flange 29 is provided which depends from arm 22, and abuts against the side of gripping member 12 when the clamp 18 is in the retracted position, as shown in FIG. 5. This flange enables one to pivot the clamp 18 between its extreme positions and prevents the possibility of pinching the user's finger tip between the clamp 18 and end portion 14. Optionally, the flange 29 may extend upward so that there is no protrusion outward of the end portion 14.

FIGS. 10 and 11 show a connector of the present invention in use with a side battery terminal S and a top battery terminal T. In use, with the clamp 18 retracted, the end portions 13, 14 are manually separated to the open state shown in FIG. 5 and the clamp 18 is pivoted to the extended position shown in FIG. 6. The end portions 13, 14 are then placed in the closed state, as shown in FIG. 4, and the clamp 18 is locked in the extended position, whereby it is snapped on the terminal S, as shown in FIG. 10.

To use the connector as shown in FIG. 11, the end portions 13, 14 are again manually separated, as shown in FIG. 6, and the clamp 18 is pivoted to the retracted position, as shown in FIG. 5, wherein the projection 30 coacts with slot 26 to maintain the clamp 18 in the retracted position. With the connector shown in the state of FIG. 5, it is now ready to engage top battery terminal T by the release of the manual separating force. The jaws formed by teeth 13' and 20 act to grip terminal T to insure a good mechanical and electrical contact.

It will thus be seen that the objects set forth above, among those made apparent from the preceding description are efficiently attained and since certain changes may be made in the connector without departing from the scope of the invention, it is intended that all matters contained in the above description or shown in the accompanying drawings shall be interpreted as illustrative and not in a limiting sense.

For example, it is clear to those skilled in the art that various equivalent, interconnected gripping members can be used and still embody the essence of the invention.

We claim:

1. A battery cable connector for alternative attachment to a top terminal of a top terminal battery and a side terminal of a side terminal battery, comprising:

first and second gripping members;

first and second jaws on end portions of said first and second gripping members respectively;

a first hinge coacting with said first and second gripping members and effective to permit manual relative rotation of said first and second jaws between a closed state and an open state;

a support member;

a second hinge pivotally joining a first end of said support member to said first gripping member;

a side battery terminal clamp at a second end of said support member;

said support member being rotatable on said second hinge between a retracted position and at least one extended position;

said side battery terminal clamp extending beyond said first jaw in said extended position and available for connection to a side battery terminal;

said side battery terminal clamp being retracted toward said first gripping member in said retracted position thereof, said retracted position permitting engagement of said first and second jaws with a top battery terminal.

2. The connector according to claim 1, wherein said jaws include teeth fixedly mounted on the inner face of the end portions of both gripping members and wherein the support member is pivotally connected at an outer face of said first gripping member.

3. The connector according to claim 2, wherein said clamp includes first and second spaced apart resiliently spreadable arms receptive of a side battery terminal therebetween and having serrations on inner edges thereof.

4. A battery cable connector for use with top and side battery terminals, the connector comprising: two resiliently movable gripping members having end portions which are manually separable from a normally closed state to an open state; means disposed on the end portions of the gripping members to form jaws for engaging a top battery terminal when the gripping members are in the closed state; means including a side battery terminal clamp mounted on one gripping member for pivotal movement of the clamp in a plane radial to the direction of movement of the end portion between a retracted position wherein the two gripping members are free to engage a top battery terminal and an extended position wherein the clamp projects from the end portions and is free to engage a side battery terminal; and wherein the pivotally mounted means comprises a support member pivotally connected at one end of the inner face of the end portion of one gripping member and having the clamp at the opposite end of the support member and wherein the means forming the jaws comprises first teeth mounted on the inner face of the end portion of the other gripping member and second teeth mounted on the inner face of the one end of the support member to form a jaw when the clamp is in the retracted position.

5. The connector according to claim 4, wherein the pivotally mounted means comprises means for maintaining the clamp in the extended position comprising said second teeth configured to engage with the first teeth to prevent movement in the radial plane when the clamp is extended and the gripping members are in the closed state.

6. The connector according to claim 5, further comprising means for maintaining the clamp in the retracted position comprising a projection on the inner face of the end portion of said one gripping member and an aperture in the support member alignable with the projection when the clamp is in the retracted position.

7. The connector according to claim 6, wherein the clamp comprises two spaced apart resilient spreadable arms receptive of a side battery terminal therebetween and having serrations on the inner edges thereof.

8. The connector according to claim 7, further comprising a flange whereby said gripping member may be engaged for rotation.

9. The connector according to claim 7, wherein the space between the arms comprises said aperture.

10. The connector according to claims 3 or 4, wherein the pivotally mounted means comprises the support member riveted to the one end portion of one member and wherein the support member is pivotable about the rivet.

11. The connector according to claims 3 or 4, wherein the pivotally mounted means comprises a pivot aperture in the support member and a pivot pin drawn out of the material of the one gripping member received in the pivot aperture and around which the support member pivots.

12. The connector according to claims 4, 5, 6, 7, 8 or 9, wherein said first teeth are mounted along the circumference of a circle and said second teeth are mounted along the circumference of a circle.

13. The connector according to claims 4, 5, 6, 7, 8 or 9, wherein said first teeth are mounted along the circumference of a circle and said second teeth are mounted along the circumference of a circle, wherein further the pivotally mounted means comprises the support member riveted to the one end portion of one member and wherein the support member is pivotable about the rivet.

14. The connector according to claims 4, 5, 6, 7, 8 or 9, wherein said first teeth are mounted along the circumference of a circle and said second teeth are mounted along the circumference of a circle, further wherein the pivotally mounted means comprises a pivot aperture in the support member and a pivot pin drawn out of the material of the one gripping member received in the pivot aperture and around which the support member pivots.

* * * * *

UNITED STATES PATENT AND TRADEMARK OFFICE

CERTIFICATE OF CORRECTION

PATENT NO. : 4,345,807
DATED : August 24, 1982
INVENTOR(S) : Joseph Shekel, et al.

It is certified that error appears in the above-identified patent and that said Letters Patent is hereby corrected as shown below:

In the drawings, sheet 2, Fig. 5, detent 30 should connect with slot 26. Sheet 4, Fig. 14, the left-hand reference numeral 31 should be 33, the right-hand reference numeral 37 should be 34. The corrected drawings appear below and attached.

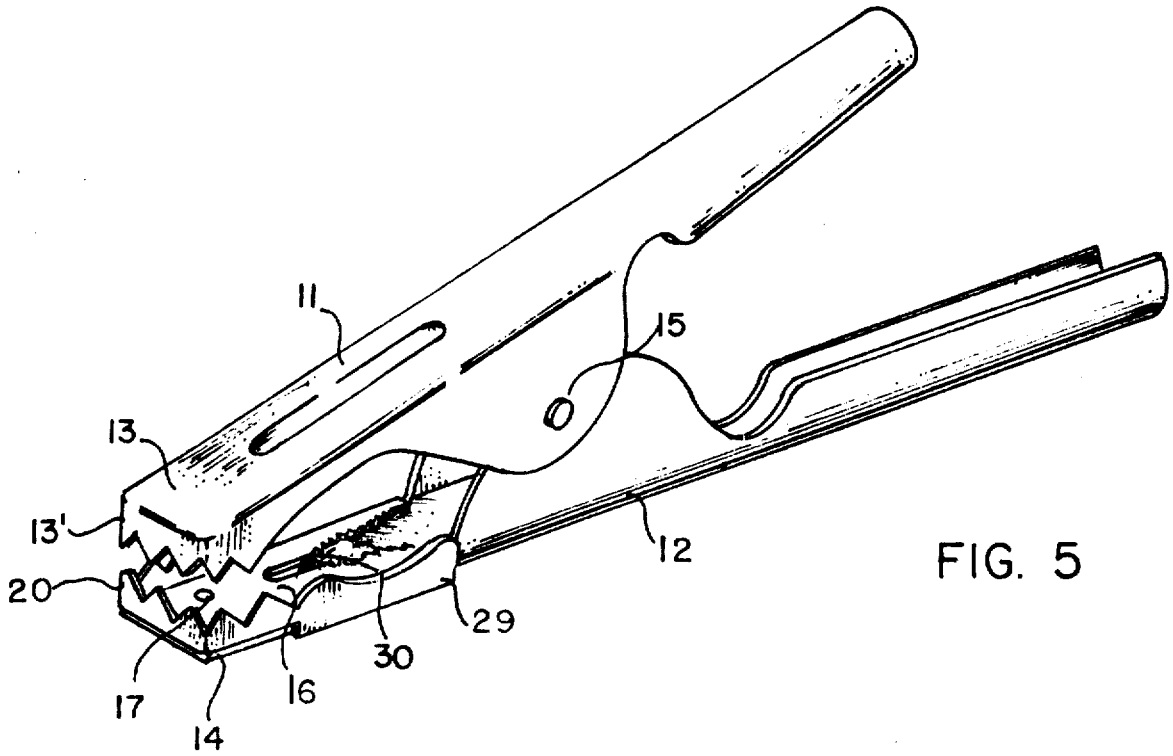

FIG. 5

UNITED STATES PATENT AND TRADEMARK OFFICE

CERTIFICATE OF CORRECTION

PATENT NO. : 4,345,807

DATED : August 24, 1982

INVENTOR(S) : Joseph Shekel, et al.

It is certified that error appears in the above-identified patent and that said Letters Patent is hereby corrected as shown below:

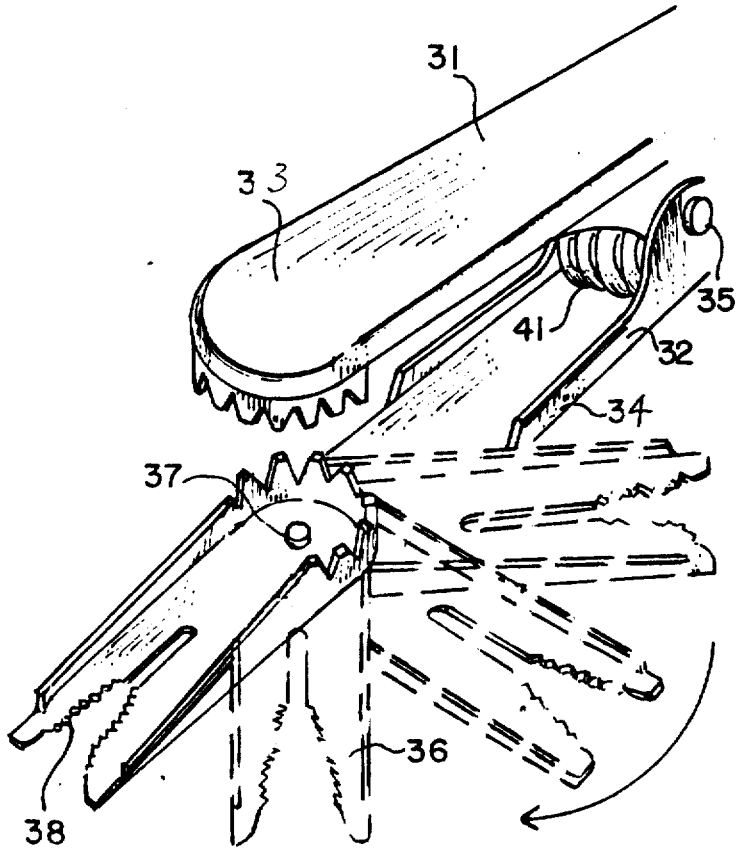

FIG. 14

UNITED STATES PATENT AND TRADEMARK OFFICE

CERTIFICATE OF CORRECTION

PATENT NO. : 4,345,807
DATED : August 24, 1980
INVENTOR(S) : Joseph Shekel, et al It is certified that error appears in the above-identified patent and that said Letters Patent is hereby corrected as shown below:

Column 3, line 63, "Figs." should read -- Fig. --; delete "and 3", column 5, line 58 before "5" insert -- . --

Signed and Sealed this

*Twenty-third* Day of *November 1982*

[SEAL]

*Attest:*

GERALD J. MOSSINGHOFF

*Attesting Officer*

*Commissioner of Patents and Trademarks*